US006454579B1

(12) United States Patent
Davis

(10) Patent No.: US 6,454,579 B1
(45) Date of Patent: Sep. 24, 2002

(54) COMPUTERIZED PLUG LOCK

(76) Inventor: Carolyn E. Davis, 5118 Clara Dr., Godfrey, IL (US) 62035

( * ) Notice: Subject to any disclaimer, the term of this patent is extended or adjusted under 35 U.S.C. 154(b) by 0 days.

(21) Appl. No.: 09/950,752

(22) Filed: Sep. 13, 2001

(51) Int. Cl.[7] ..... H01R 13/44
(52) U.S. Cl. ..... 439/134
(58) Field of Search ..... 439/133, 134, 439/304, 535, 901, 915; 70/52, 63, 277, 278, 54, 55, 57, 58; 340/825.69, 825.22

(56) References Cited

U.S. PATENT DOCUMENTS

| | | | | |
|---|---|---|---|---|
| 4,063,110 A | * | 12/1977 | Glick | 307/112 |
| 4,488,764 A | * | 12/1984 | Pfenning et al. | 439/304 |
| 4,673,230 A | | 6/1987 | Baumgart | 439/133 |
| 4,782,971 A | | 11/1988 | Hill | 220/3.2 |
| 4,838,052 A | * | 6/1989 | Williams et al. | 70/63 |
| D344,443 S | * | 2/1994 | Ashby | D8/346 |
| 5,434,368 A | | 7/1995 | Hoffman | 200/43.22 |
| 5,507,656 A | | 4/1996 | Ales | 439/133 |
| 5,731,763 A | * | 3/1998 | Herwck et al. | 340/825.69 |
| 6,060,979 A | * | 5/2000 | Eichsteadt | 340/287 |
| 6,142,797 A | | 11/2000 | Bailey | 439/134 |

FOREIGN PATENT DOCUMENTS

| | | | | |
|---|---|---|---|---|
| JP | 11-237176 | * | 8/1999 | 439/134 |

* cited by examiner

*Primary Examiner*—Neil Abrams
*Assistant Examiner*—J. F. Duverne
(74) *Attorney, Agent, or Firm*—Patent & Trademark Services; Thomas Zack; Joseph H. McGlynn

(57) ABSTRACT

A locking device for an electrical plug. The device has a housing and a cover which can be opened only with a coded key pad. The housing has internal contacts which allow the plug to be connected to a standard receptacle, or which allow the plug to be disconnected from the contacts in the housing to allow the plug to be electrically disconnected from the receptacle.

4 Claims, 3 Drawing Sheets

COMPUTERIZED PLUG LOCK

BACKGROUND OF THE INVENTION

This invention relates in general to locks, and in particular to locks for an electrical plug which can be opened only with a coded key pad.

DESCRIPTION OF THE PRIOR ART

Locking devices that are used to prevent electrical contact between an electrical plug and a wall socket are known in the prior art. For example, U.S. Pat. No. 4,673,230 to Baumgart discloses a device for preventing unauthorized use of an electrical plug having a housing which receives the plug and a lock for preventing the plug from being electrically connected to a receptacle.

U.S. Pat. No. 4,782,971 to Hill discloses a lock box for an electrical plug which has two parts which slide together and which receive a plug there between and which have a key lock.

U.S. Pat. No. 5,434,368 to Hoffman discloses an apparatus for controlling the use of electrical connectors and which has a key pad to prevent unauthorized use.

U.S. Pat. No. 5,507,656 to Ales discloses a housing for receiving a plug and a lock to prevent the plug from being electrically connected to a receptacle.

U.S. Pat. No. 6,142,797 to Bailey discloses an electrical plug lock Gil which has a key operated cam to engage a plug and prevent the plug from being electrically connected to a receptacle.

The present invention is directed to a locking device having a housing with a hinged cover that can only be opened with a coded key pad. The housing has contacts that will allow the plug to be connected through the housing to a standard receptacle, or will allow the plug to be disconnected from the contacts in the housing and not allow the plug to be electrically connected to the receptacle, all as will be detailed in the specification that follows hereafter.

SUMMARY OF THE INVENTION

This invention relates to a locking device with a hinged cover which can be opened only with a coded key pad. The housing has contacts which allow the plug to be connected through the housing to a standard receptacle, or will allow the plug to be disconnected from the contacts in the housing and not allow the plug to be electrically connected to the receptacle.

It is the primary object of the present invention to provide for an improved locking device for an electrical receptacle.

Another object is to provide for such a device in which there is a housing with a hinged cover that can only be opened with a coded key pad with the housing having contacts which allow the plug to be connected through the housing to a standard receptacle.

A still further object is to provide for a locking device which allows the plug to be electrically disconnected from the contacts in the housing and will not allow the plug to be electrically connected to the receptacle.

These and other objects and advantages of the present invention will become apparent to readers from a consideration of the ensuing description and the accompanying drawings.

DESCRIPTION OF THE PREFERRED EMBODIMENT

Figure 1:
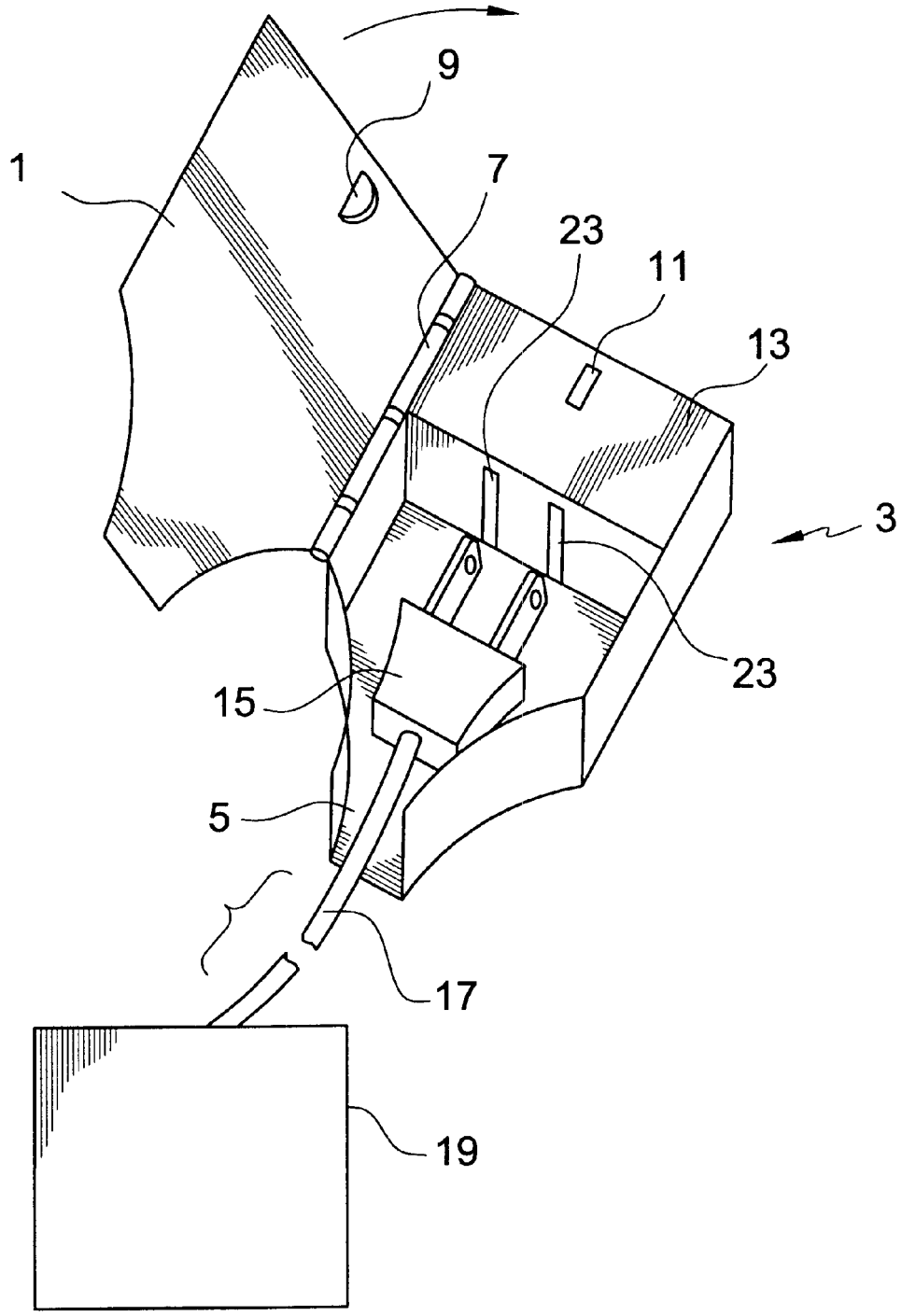
FIG. 1 is a perspective view of the present invention showing the hinged cover in an opened position with the plug disconnected from the receptacle.

FIG. 1 is a perspective view of the present invention showing the hinged cover 1 of housing 3 in an opened position. The housing 3 is generally closed on all sides except for the top where the cover 1 is attached and a small opening 5. Hinges 7 extend along one side of cover 1 to permit the cover to be pivoted over the opened top of the housing 3. The cover 1 carries a latch member 9 that cooperates with an opening 11 of the locking pad system 13. Within the opening 11 is a conventional latch engaging member (not shown) that can engage latch member 9 and lock the cover 1 in a closed position.

Figure 2:
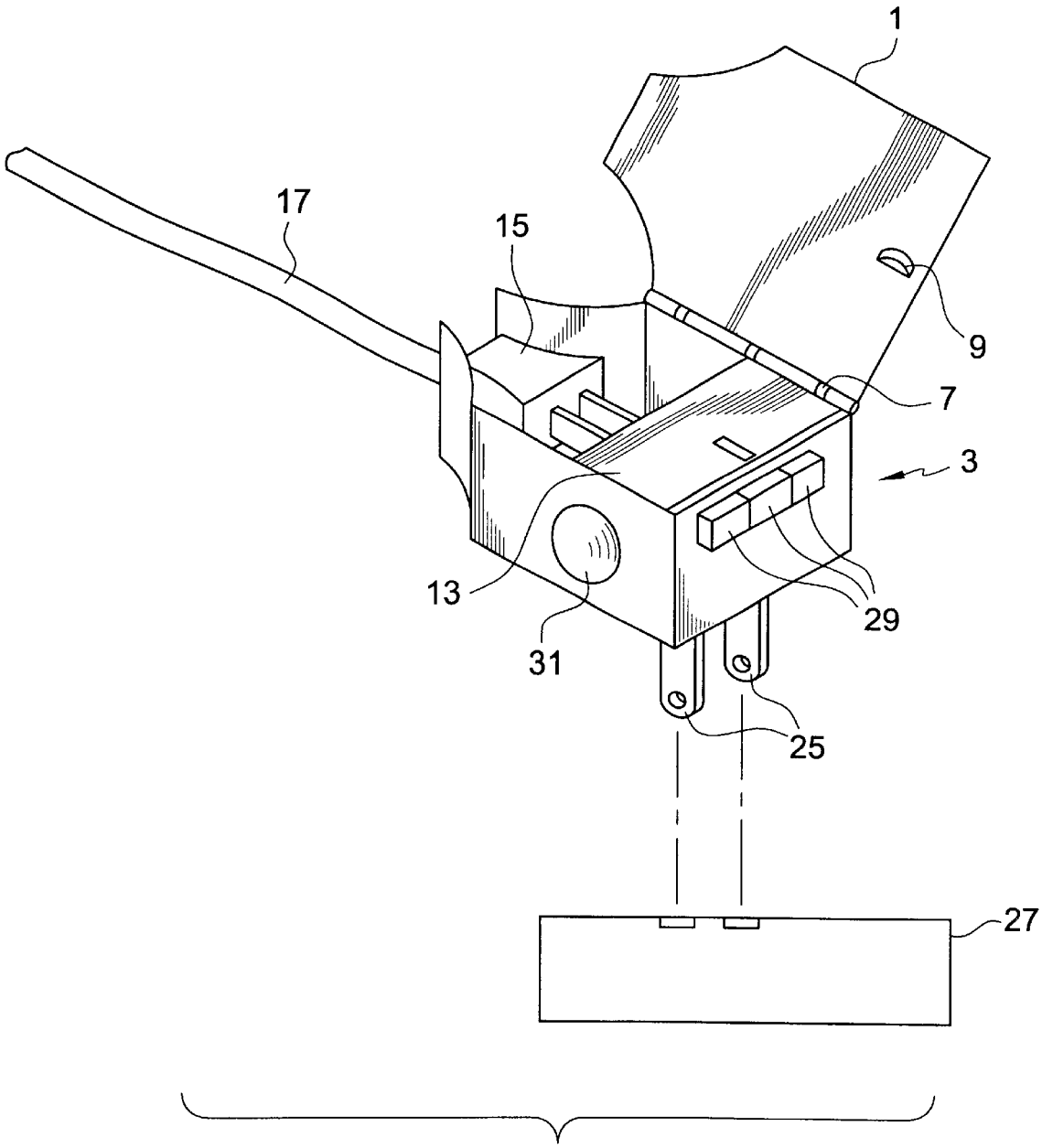
FIG. 2 is another perspective view of the invention from another angle.

An electrical plug 15 is placed within the housing 3. A wire 17 fixed to the plug 15 extends out of the housing 3 to an electrically operated apparatus 19. Prongs 21 on the plug 15 are positioned such that they may be pushed into electrical contacts 23 located in the locking pad system 13. As depicted in FIG. 2, there are additional electrical prongs 25 extending from the lower surface of housing 3 that permit connection to an electrical power source or receptacle 27. The electrically operated apparatus 19 can be any conventional electrically operated apparatus including, but not limited to, power tools, such as a saw, planer, router, a computer, a stereo, etc.

As is clear from FIG. 1, the plug 15 is larger than opening 5 through which the wire 17 extends. This means that when the cover 1 is in a latched position, there is no electrical power being supplied to the apparatus 19, as long as plug 15 is not electrically engaged with the contacts 23. To supply power to the apparatus 19, the cover 1 must be unlatched and opened, and then the plug 15 must be inserted into contacts 23.

FIG. 2 is another perspective view of the present invention from another angle. In this view, two prongs 25 extending from the bottom of the housing 3 are shown. The prongs 25 electrically connects the internal circuitry of the locking pad system 13 to a conventional external electrical power source 27, such as a wall receptacle. On a side of housing 3 are three keys 29 used to input data into the conventional locking pad system 13. Numbers, letters or other indicia may be imprinted on the visible face of the keys 29. Normally, different indicia is placed on each key to distinguish it from the other keys. When the cover 1 is closed and latched, the keypad, formed by the keys 29, must be actuated in a predetermined sequence to unlatch the cover 1 and permit it to be opened. Thus, the sequence is programmable and may be changed such that different locking devices can have different combinations to open them. In an emergency, a lock release circuit within the locking pad system 13 may be actuated to bypass the keypad to open the cover.

Also shown in FIG. 2 is a tamper proof alarm 31. The alarm 31 will give off a loud sound should one attempt to pry open the latched cover 1 without pressing the keys 29 in the proper programmed order. A visual alarm could also be used or both types of alarms could be used in combination. It should be clear that the configuration and size of the housing is such that the plug 15 mounts easily within its confines but may not be withdrawn or connected to contacts 23 without opening the closed and latched cover 1. Thus, the prongs may be inserted into the conventional power receptor 27 with the housing cover 1 closed and latched, giving the appearance of a plugged in electrical apparatus. Unless, the plug 15 is pushed into the contacts 23 no current will flow to the remote apparatus 19.

Figure 3:
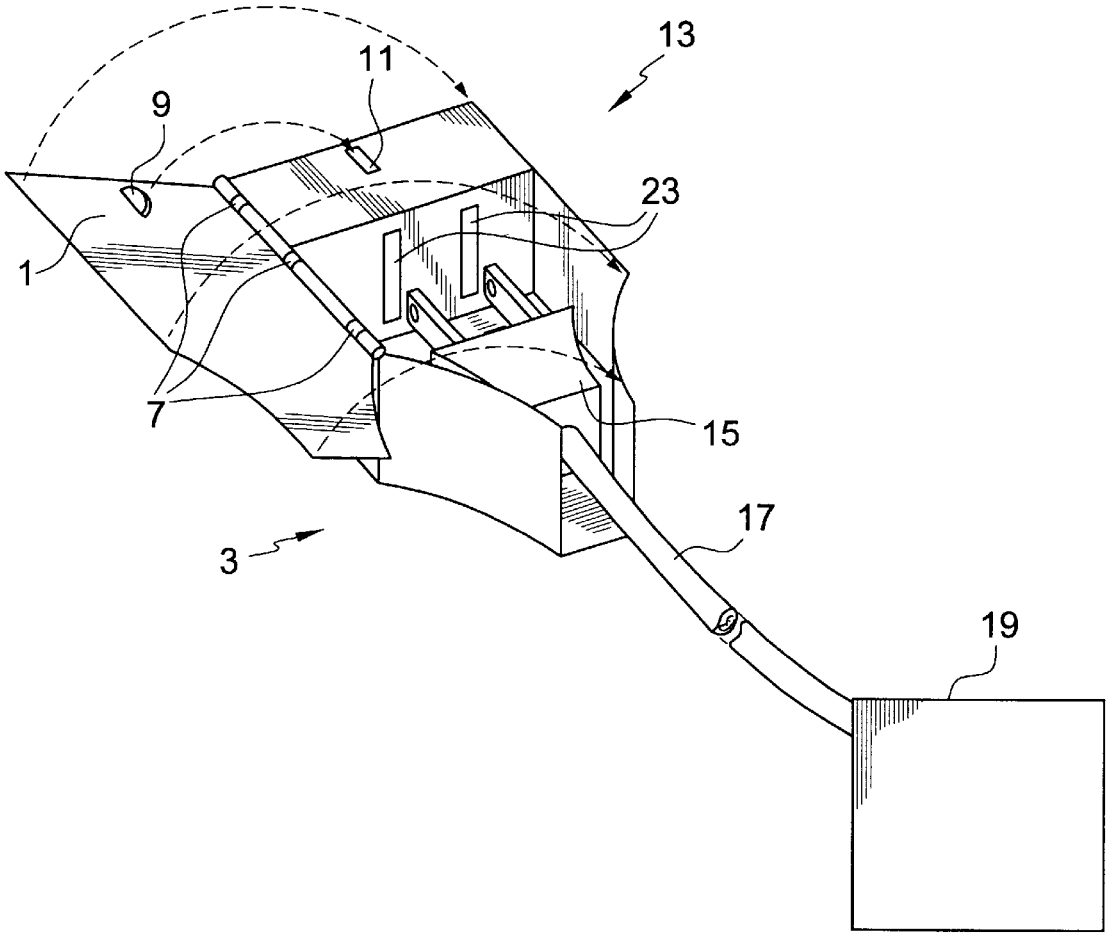
FIG. 3 is still another perspective view of the invention from a different angle showing the connector for the insertable plug.

FIG. 3 is still another perspective view of the present invention from a different angle showing the connector. The cover 1 is again shown in an opened position. The arrows and dotted lines indicate the path of travel for the difference points of the cover 1 when pivoted on hinges 7 to a closed position. The cover latch 9 would be inserted into the opening 11 and the complimentarily shaped and sized edges of the cover would meet the edges of the top opened housing 3.

The internal electronics of the locking pad system 13 have conventional components that interact as described and, therefore are not disclosed in detail. Since the housing acts to protect the interconnection between the plug 15 and the contacts 23, it should be made of a sturdy material. The cover 1 and housing 3 may be made of metal or plastic material. A computer chip in the locking pad system 13 permits the use of different programmable codes that must be used to access and unlatch the housing. While only three keys 29 are shown, if desired, more keys can be added to make the access code more complex. In addition, the housing acts to retain the apparatus plug 15 within the housing to insure it is not inserted when disconnected until desired.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A locking device for an electrical receptacle comprising:

a housing having a hinged cover which can be closed and latched, said housing having a first plug means for electrical connection to an electrical power supply, a second plug means for connection to an electrically operated apparatus, said housing having electrical contact means for receiving said second plug means, when said electrical contact means is said housing is engaged with said second plug means electrical power will be supplied to said electrically operated apparatus, a locking means for locking said hinged cover to said housing, said locking means having preselected keys that are programmable to permit the opening of the hinged cover only when preselected keys of the locking means are actuated in a preselected order, and an alarm operatively associated with said locking means, said alarm being actuated when the cover is opened without said preselected keys being actuated in the preselected order.

2. The locking device as claimed in claim 1, wherein said second plug means has a power conduit connected to the second plug means, said power conduit extends from the housing, said housing having an opening smaller than said second plug means to prevent the second plug means from being withdrawn from said housing without opening said hinged cover.

3. The locking device as claimed in claim 2, wherein said cover has a latch which is received by an opening in the locking means.

4. The locking device as claimed in claim 1, wherein said alarm is an audio alarm.

* * * * *